US011751615B1

(12) United States Patent
Wilke et al.

(10) Patent No.: US 11,751,615 B1
(45) Date of Patent: Sep. 12, 2023

(54) SECOND-SKIN RESPIRATOR COVER

(71) Applicant: Combat Capabilities Development Command, Chemical Biological Center, APG, MD (US)

(72) Inventors: Douglas E Wilke, Joppa, MD (US); Daniel J Barker, Red Lion, PA (US); Corey M Grove, Red Lion, PA (US); Michael A Lorenz, Gahanna, OH (US); Oren Shai, Columbus, OH (US); Chad Cook, Columbus, OH (US); Stephanie Tew, Columbus, OH (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 877 days.

(21) Appl. No.: 16/451,462

(22) Filed: Jun. 25, 2019

(51) Int. Cl.
*A41D 13/11* (2006.01)
*A62B 18/02* (2006.01)
*A62B 23/02* (2006.01)

(52) U.S. Cl.
CPC ..... *A41D 13/1161* (2013.01); *A62B 18/02* (2013.01); *A41D 13/1107* (2013.01); *A62B 23/02* (2013.01)

(58) Field of Classification Search
CPC .... A41D 13/11–1192; A62B 18/00–10; A62B 23/00–025
See application file for complete search history.

(56) References Cited

U.S. PATENT DOCUMENTS 1,975,797 A * 10/1934 Montuori ..... A62B 18/00 128/205.27
2,671,445 A * 3/1954 Charbonnel ..... A62B 18/00 128/201.12
2,740,400 A * 4/1956 Wines ..... A62B 18/00 D24/110.2
2,810,385 A * 10/1957 Reed ..... A62B 18/084 128/202.13
2,821,192 A * 1/1958 Monro ..... A62B 18/02 128/201.15
3,181,531 A * 5/1965 Angioletti ..... A62B 18/02 128/201.15
4,579,113 A * 4/1986 McCreadie ..... A62B 18/08 128/202.13
5,505,197 A * 4/1996 Scholey ..... A62B 18/00 128/206.17
5,575,278 A * 11/1996 Bonhomme ..... A62B 18/04 2/6.2
9,861,529 B2 * 1/2018 Seo ..... A61F 9/022

* cited by examiner

*Primary Examiner* — Michelle J Lee
(74) *Attorney, Agent, or Firm* — Ulysses John Biffoni

(57) ABSTRACT

A respirator cover or second-skin includes a support structure to cover a gas mask or respirator and is provided with cut-outs in the support structure to receive components of the respirator, the second-skin including an interior flexible gasket concentric and spaced from the outer perimeter of the second-skin which seals the cover to the outer surface of the respirator. The second skin serves to provide increased chemical protection to the user of a respirator, as an aid for garment interface, or to anchor a protective hood to the respirator.

14 Claims, 6 Drawing Sheets

SECOND-SKIN RESPIRATOR COVER

GOVERNMENT INTEREST

The invention described herein may be manufactured, used and licensed by or for the United States Government.

FIELD OF THE INVENTION

The present invention relates to a respirator assembly for the protection of personnel against contaminated or otherwise irrespirable environments. It has particular application for use by aircrew or other military personnel who may be exposed to the risk of nuclear, biological, or chemical (NBC) attack, but may be found to be of more general application wherever a breathing apparatus must be used, e.g., in firefighting or for industrial users where work must be performed in hazardous environments. In particular, this invention relates to improvements in respirator covers that are known as second-skins.

BACKGROUND OF THE INVENTION

Numerous types of respirators for respiratory protection systems are known that deliver breathing air and/or filtered breathing air to a user. Such respirators have different performance requirements depending on the circumstances in which the devices are intended to be used. Examples of respirators include self-contained breathing apparatus (SCBAs), air purification respirators (APRs), powered air purification respirators (PAPRs) and the like that supply pressurized air or that filter or cleanse ambient air. Such respirators are worn as masks by firefighters, in industrial applications such as in coating applications, and in the military where the air supply may be contaminated. While the present invention has particular application for use by military personnel who may be exposed to the risk of nuclear, biological, or chemical (NBC) attack, the invention herein may be found to be useful in general applications wherever a breathing apparatus must be used and placed against the face of a user where tasks must be performed in hazardous environments.

It is recognized that wearing a conventional respirator requires the whole head or at least the face of the user including the nose, mouth, and eyes to be isolated from the external environment. Respirators may utilize exterior coverings for several purposes including increased chemical protection, an aid for garment interface, or to anchor a protective hood to the respirator. The cover increases isolation from the environment and prevents toxic chemical dermal contact for the user, aids with additional garment interface such as connection to protective suits, and also to anchor a protective hood to the respirator. These coverings are commonly referred to as second-skins. Previously, second-skins have been used by the U.S. military with respirators. These second-skins were connected to ridged parts of the respirator by stretching the second-skin around such features to retain the second-skin in place to and against the respirator. However, in certain respirators/masks such as in the case of the Avon Protection Systems C50 protective mask, the lens placed around the eyes of the user is recessed and lacks a ridged external feature to allow a second-skin to be stretched around the lens. Additionally second skins historically lack a single unified seal which seals the $2^{nd}$ skin to the respirator which could allow contaminants to enter between the respirator and the second-skin and eventually might cause harm to the user.

SUMMARY OF THE INVENTION

The respirator cover or second-skin of the present invention is structured to cover a respirator and provided with cut-outs, for example, to receive the exhalation valve cover, filter seats, drink tube stowage, and the primary lens which may be present in the respirator such as, for example, the M50 Joint Service General Purpose Mask (JSGPM) used by the U.S. military. The second-skin of the present invention provides center line locators to allow the proper nesting and sealing of the visor and holds the second-skin onto the topside of the visor to ensure that if a chemical/biological protective hood is installed over the second-skin, such hood will not pull the second-skin away from the respirator if the hood pulls back. Additionally, a rigid insert along with a full perimeter smooth landing surface on the exterior of the second-skin provides a simple and universal geometry to accommodate all types of hoods so that any hood will effectively lay against the surface of the second-skin to limit ingress of the hazardous environment and minimize contaminants from entering into the hood and reaching the users head and neck.

Importantly, the second-skin of this invention also includes an integral flexible perimeter gasket which seals the second-skin to the respirator. This single continuous seal provides protection to prevent ingress of any leakage of contaminants between the second skin and the respirator, thereby preventing contaminants from the hazardous environment from reaching the user's head and neck.

DETAILED DESCRIPTION OF THE EMBODIMENTS OF THE INVENTION

While the second-skin of the present invention will be described herein for particular use with the M50 respirator, it is to be understood that the second-skin of this invention, and the particular advantageous features thereof can be provided in second-skins used for other proprietary military respirators or, in general, for any respirator in commercial use needed to separate a user from a hazardous or contaminated environment.

Figure 1:
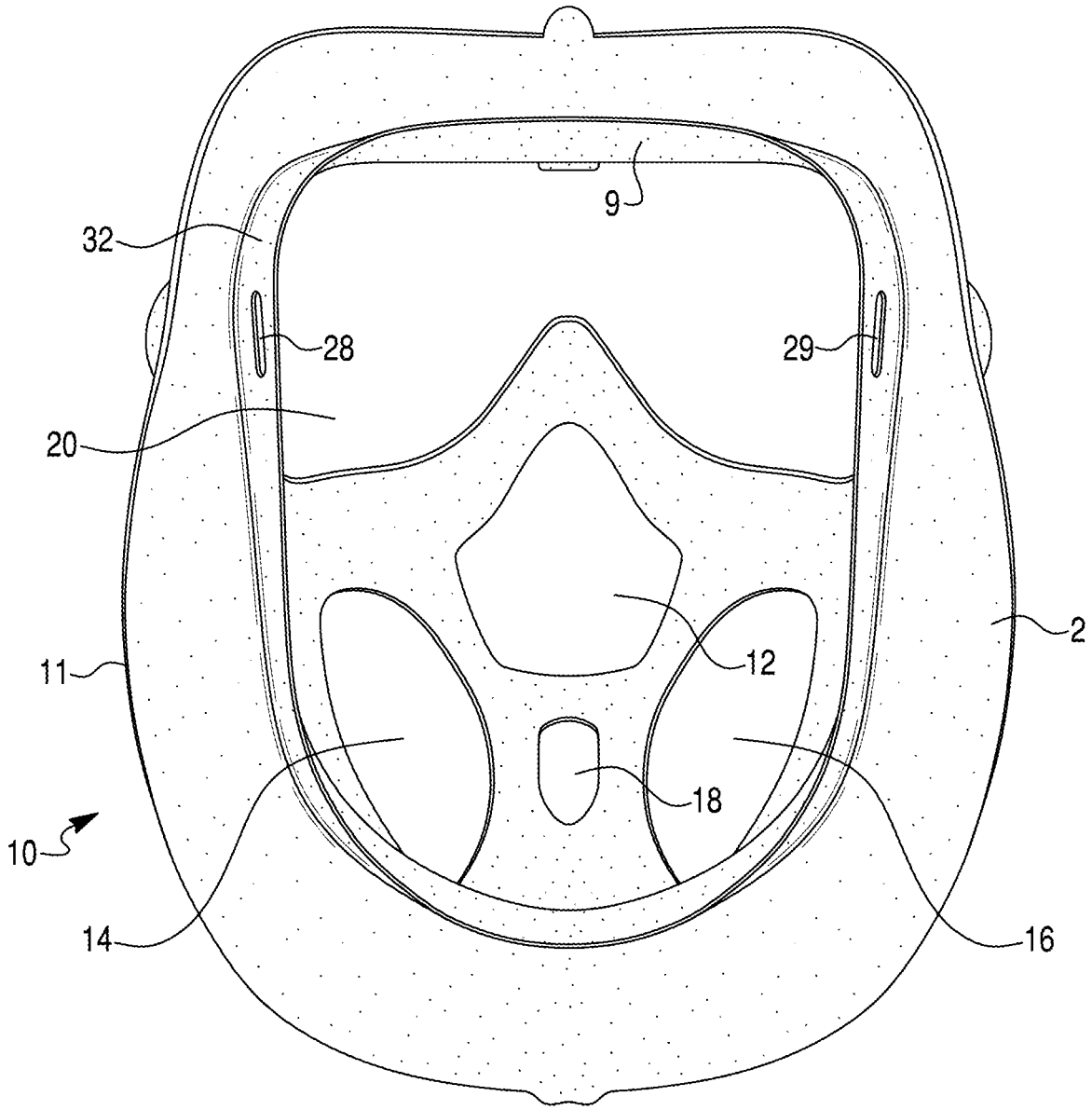
FIG. 1 is a plan view of the rear and interior of the respirator cover and second-skin of this invention.
Figure 2:
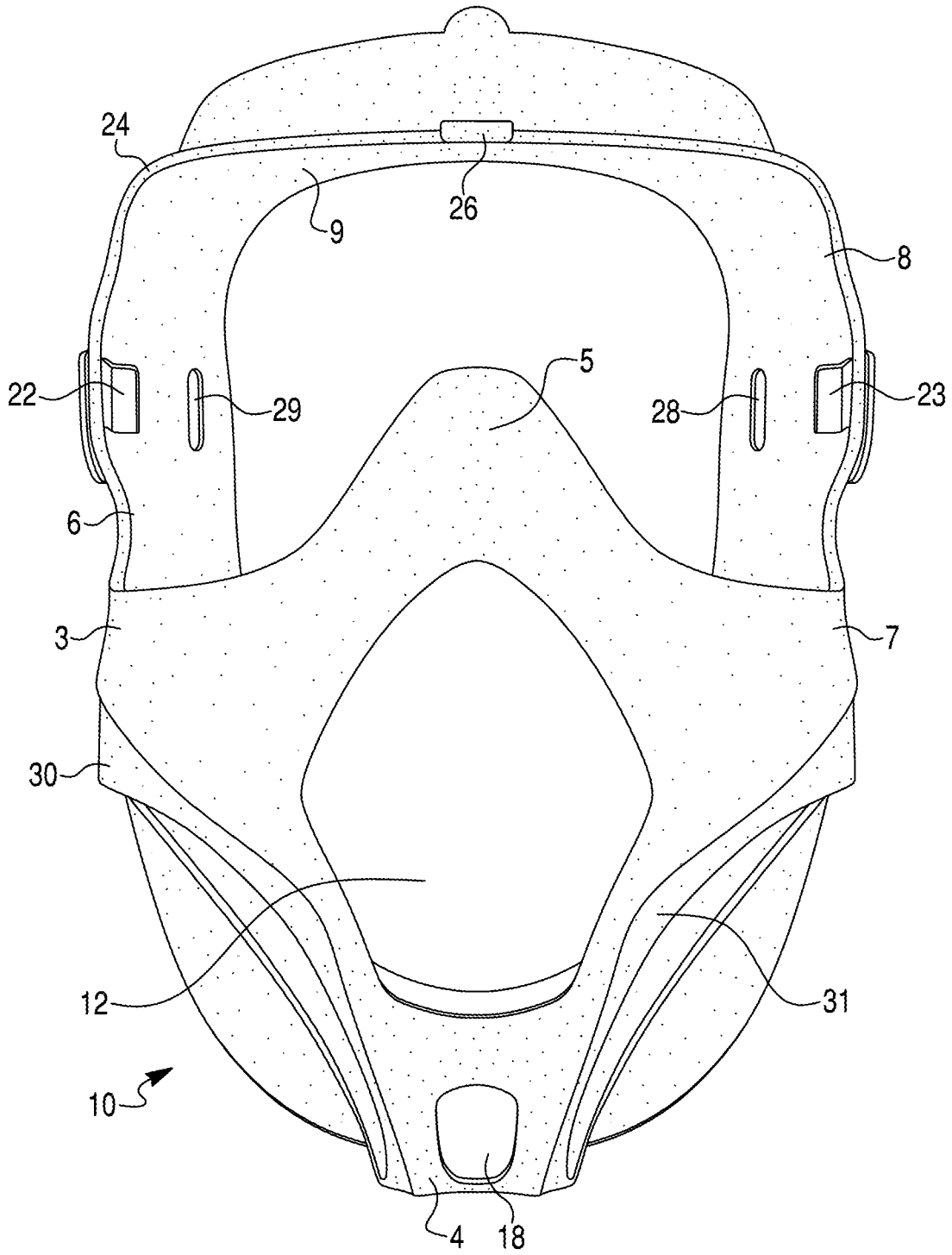
FIG. 2 is a front and exterior view of the second-skin of this invention.
Figure 4:
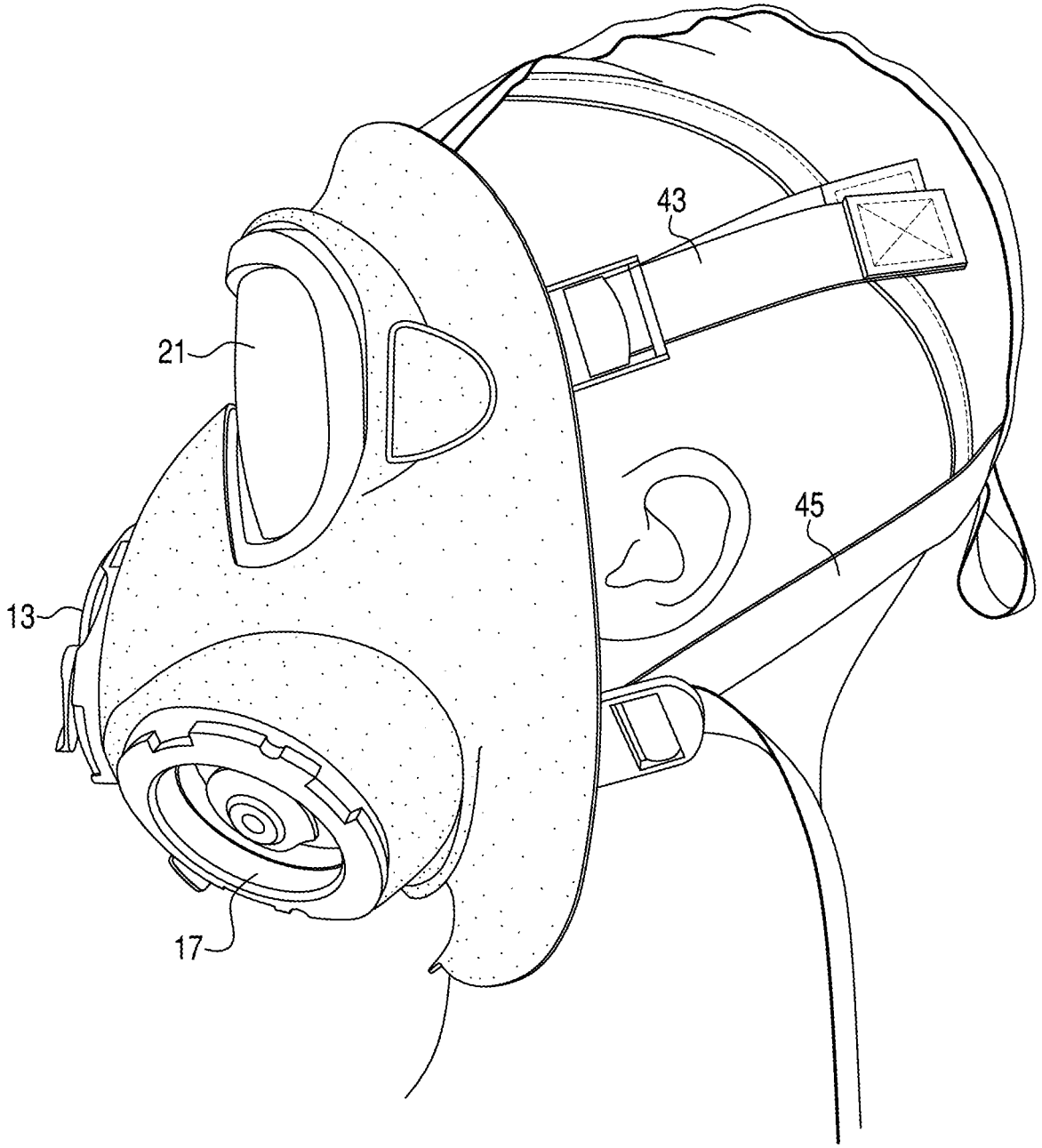
FIG. 4 is a perspective side view of the second-skin of this invention in combination with a respirator shown on the head of a user.
Figure 6:
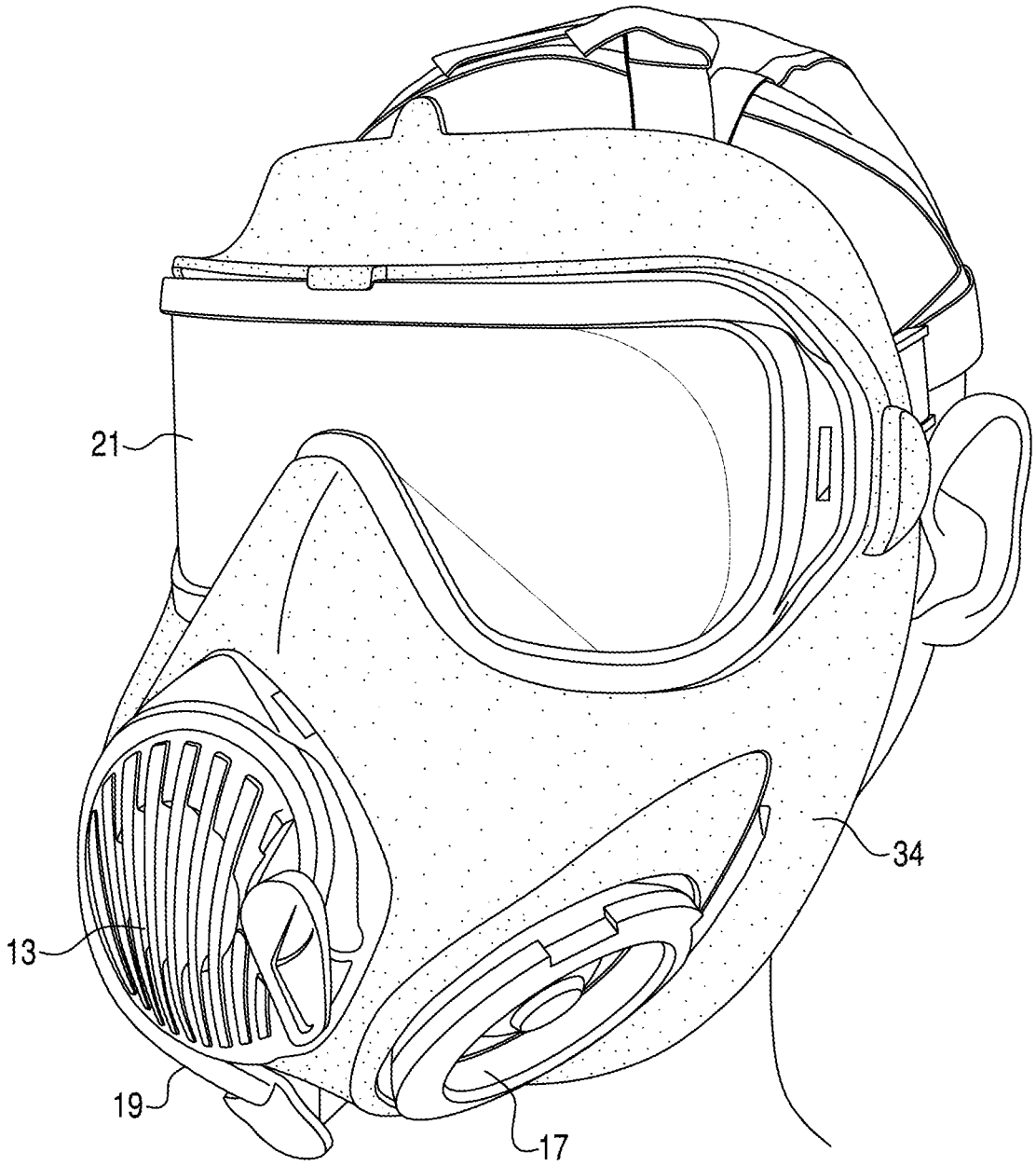
FIG. 6 is perspective front view of the second-skin of this invention in combination with a respirator shown on the head of a user.

Referring to FIGS. 1 and 2, the second-skin 10 of this invention comprises a concave interior such as shown in FIG. 1 and a convex exterior such as shown in FIG. 2 to accommodate a respirator which is placed on the face and head of a user. The perimeter 2 of cover 10 is shaped to the contour of a respirator mask and the head and face of the user. Second-skin 10, when placed on the face of a user, includes a support structure 3 on the side of cover 10 located on the cheek of the user, support 5 which covers the bridge of the nose and support 7 on the side of cover 10 at the opposite cheek as support 3. A chin support 4 is provided integral with supports 3, 5, and 7. Cover 10 further includes respective temple support sides 6 and 8 connected by a brow support 9. All of these support structures are molded as a single piece to form cover 10 which fits as one piece against a respirator as shown in FIGS. 4 and 6.

The support structures 3, 5, 7, 4, 6, 8, and 9 can be formed of any natural or synthetic rubber or plastic having the appropriate hardness, flexibility, and chemical stability needed to withstand continuous use in hazardous or contaminated environments. Such physical and chemical characteristics may vary depending on the respirator that is being covered and use thereof. Preferably, the support structures enumerated above, and which form cover 10 are made of a rigid synthetic rubber or plastic which forms a core structure that is then covered and molded with a more flexible material to form an exterior covering for core 10. The flexible material can also be molded to form other features of cover 10 to be describe below.

Referring to FIGS. 1 and 2, the second-skin 10, includes various cut-outs surrounded by the support structure which receive and engulf the components of a particular respirator. Thus, cut-out 12, formed between support structures 3, 5, 7 and chin support 4, receives the exhalation valve cover 13 shown in FIGS. 4 and 6. Cut-outs 14 and 16 accommodate filter seats 17 shown in FIGS. 4 and 6. Cut-out 18 within chin support 4 accommodates a drink tube 19 shown in FIG. 6. Cut-out 20 between the temple supports 6 and 8, and brow support 9, and nose bridge support 5 accommodates the primary visor 21 shown in FIGS. 4 and 6. For particular use with the U.S. military M50 mask, or other respirators which include visor outsert tabs, such tabs can be nested inside the visor tab recesses 22 and 23 placed in temple supports 6 and 8, respectively shown in FIG. 2. A rigid brow outsert 24 connects the visor tab recesses 22 and 23 and is located in brow support 9 around the top of the primary visor cut-out 20. A retention tab 26 is present at the center of the rigid outsert 24 and can be used to hook an outsert of the primary visor 21, see FIGS. 2 and 6. The rigid outsert 24 is a novel feature for second-skins and spans from side-to-side around the entire primary visor 21 and from temple support 6 to temple support 8. This along with the nesting of the visor 21 into visor tab recesses 22 and 23 holds the second-skin 10 onto the topside of the visor. This retention ensures that if a protective hood is installed over the second-skin, the hood will not pull the second-skin 10 away from the respirator if the hood is pulled back. Previous hoods had a Velcro strap that looped around the respirator and, thus, required installation of the hood prior to donning the respirator. The rigid outsert 24 along brow support 9 allows the hood to be donned by the user after the respirator is in place.

As shown in FIGS. 1 and 2, pass-through slots 28 and 29 on opposite temple supports 6 and 8, respectively, of second-skin 10 receive the temple straps 43 and 44 of the respirator 40 and once placed around the head of the user causes the second-skin to be sealed against the respirator surface, see FIG. 5 which will be described in more detail below.

Figure 3:
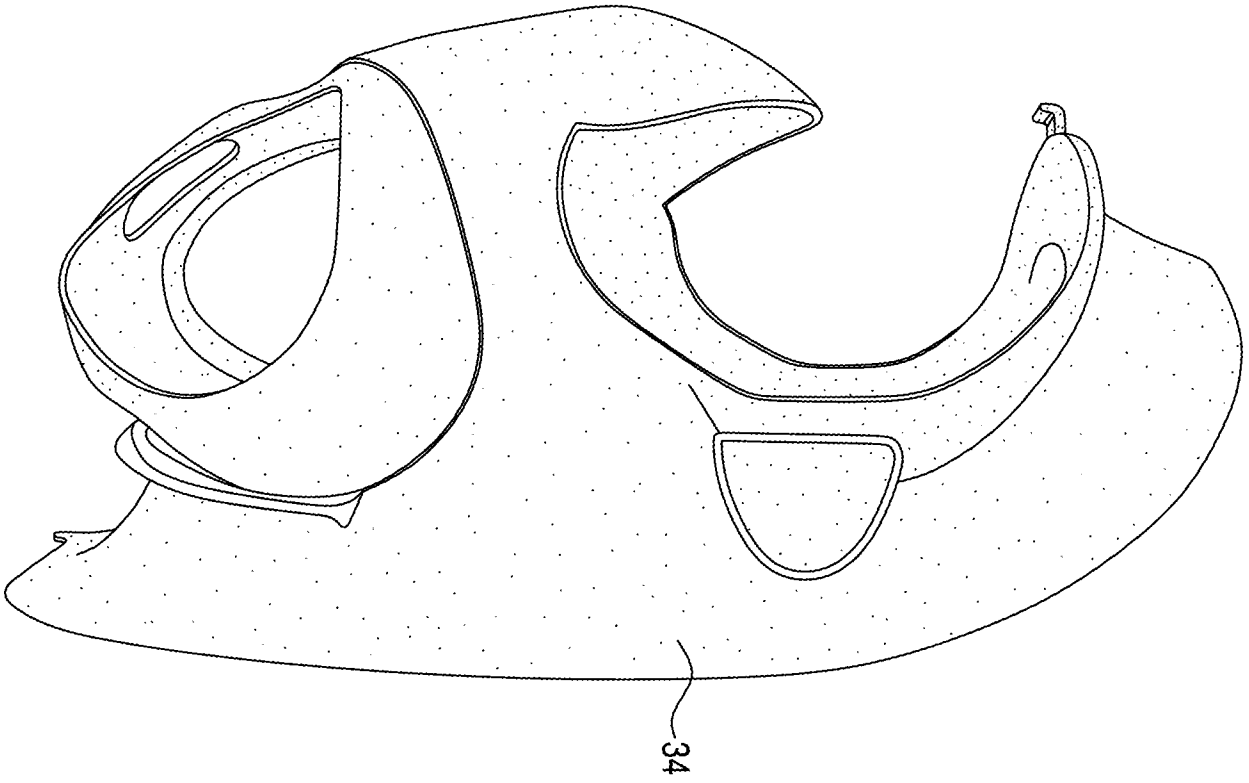
FIG. 3 is a side exterior view of the second-skin of this invention.

As shown in FIGS. 2 and 3, the second-skin 10 can include reliefs 30 and 31 in cheek supports 3 and 7, respectively, to allow proper alignment of filters, such as filter 17, over the top of second-skin 10 as shown in FIGS. 4 and 6.

As shown in FIG. 1, second-skin 10 includes an integral flexible gasket 32, concentric and spaced from the outer edge 11 of perimeter 2 and which extends around an inner perimeter of second-skin 10. Flexible gasket 32 makes surface contact with the outer surface of the respirator forming a full and continuous seal therebetween. The gasket 32 includes the slots or pass-throughs 28 and 29 to secure the respirator temple straps. The gasket 32 is preferably formed integral with the body of the second-skin 10 and is formed from a flexible synthetic plastic, natural or synthetic rubber. The flexible gasket 32 is a novel feature of second-skin 10 and forms an additional seal around the entire respirator. If any of the cut-outs in the second-skin 10 leak between the respirator and the second-skin 10, the gasket 32 prevents ingress of the contaminants to the user's head and neck.

While not wishing to limit the invention to any extent, a non-limiting method of forming cover 10 with the rigid support structures and the flexible gasket 32 involves initially molding the support structures which form perimeter 2, cheek supports 3 and 5, nose bridge support 7, chin support 4, temple supports 6 and 8, and brow support 9 along with rigid outsert 24 as a single core formed from a rigid material. Synthetic plastics or rubbers of any type can be used, and the type of plastic is not a limiting factor of this invention as long as the material is strong enough and sufficiently chemically resistant to withstand the environment in which the invention is to be used. Once formed, the rigid core structure can then be used as a mold insert and additional material can be added to the mold to cover the rigid core structure with a more flexible material and provide for additional features such as flexible gasket 32. In this way, the rigid core is now covered with a thin layer of flexible material and the flexible gasket is formed integral with the core structure. Again, it is possible that other methods of forming cover 10 can be utilized and all such methods would be acceptable so long as the shape of the cover is appropriate and the appropriate cut-outs and flexible gasket to seal against the respirator are formed.

Figure 5:
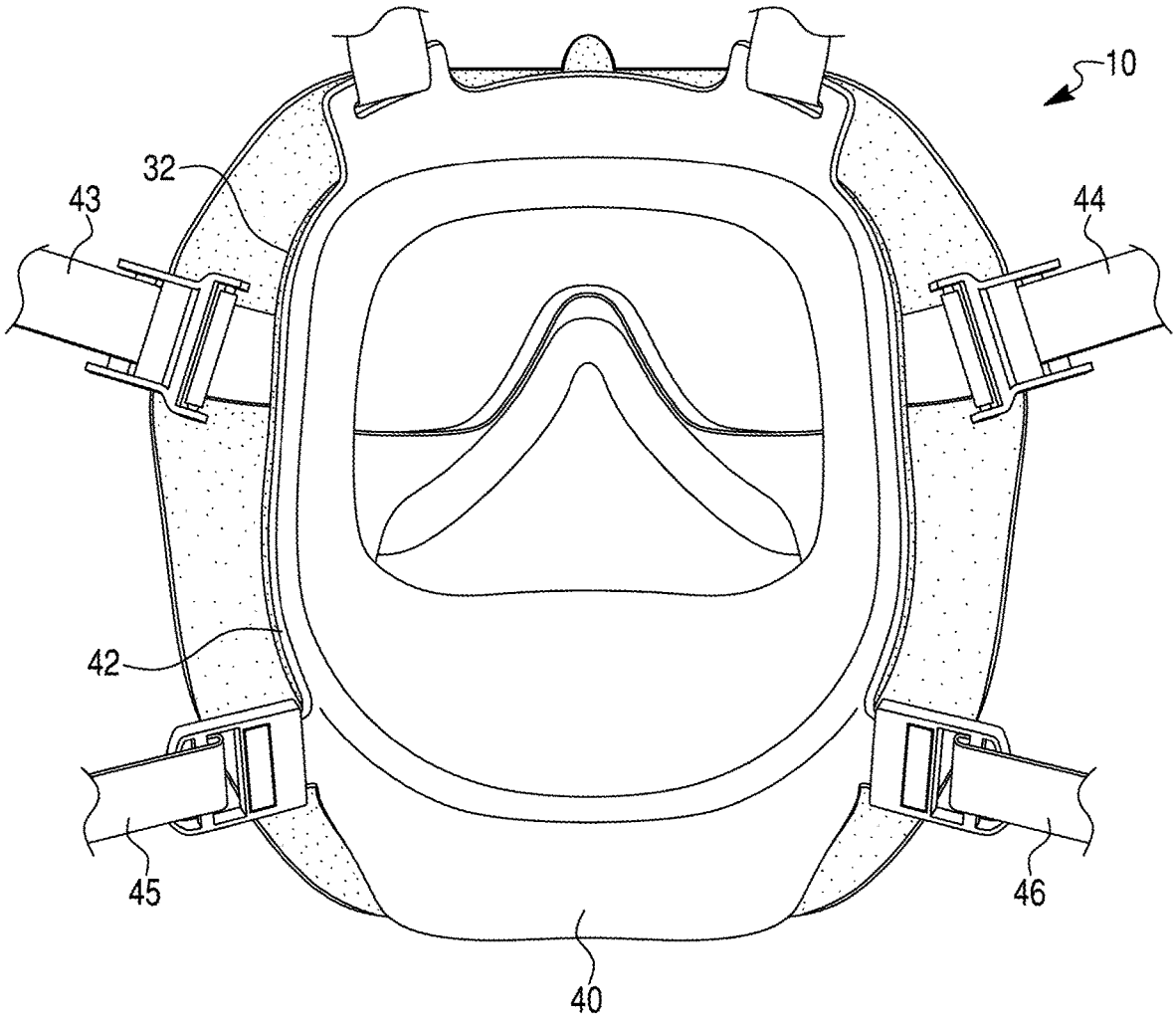
FIG. 5 is an interior view of the second-skin of this invention placed over a respirator.

FIG. 5 shows the interior of the respirator 40 which is covered by the second-skin 10 of this invention and shows the gasket 32 sealed against the outer surface 42 of the respirator 40. When temple straps 43 and 44 are pulled across the temple as shown in FIG. 4, the flexible gasket 32 seals against the outside surface 42 of the respirator 40. Additional straps 45 and 46 at the bottom of the respirator 40 attach respirator 40 to the chin and against the back of the head of the user as shown in FIG. 4.

As shown in FIG. 3, second-skin 10 includes an exterior smooth landing surface or flattened exterior surface 34 formed partly by cheek support structures 3 and 7 to allow a chemical/biological protective hood (not shown) to interface cleanly with the second-skin 10. The smooth landing surface 34 accommodates all types of hoods such that surface 34 and the hood provide sufficient surface area contact to limit ingress of the hazardous environment and minimize the amount of contaminants from entering into the hood and contacting the user.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of exemplary embodiments, those skilled in the art will recognize that the embodiments herein can be practiced with modification within the spirit and scope of the appended claims.

The invention claimed is:

1. A respirator cover or second-skin, comprising: a support structure adapted to cover a respirator placed on the head and face of a user, the second-skin having a concave interior to accommodate the respirator and including cut-outs in said support structure to receive at least a visor, an exhalation valve, and one or more respirator filters of the respirator, wherein said support structure includes spaced temple supports and a brow support extending between said temple supports, said temple supports and brow support forming the visor cut-out which receives the visor of the respirator therebetween, said brow support including a rigid brow outsert located around an edge of the visor cut-out, wherein said rigid brow outsert includes a retention tab placed therein for connection to the respirator visor, and wherein each of said temple supports includes a recess to receive and connect to outsert tabs from the respirator visor so that the rigid brow outsert retention tab and the temple support recesses secure the second skin to the respirator visor so that the second skin will not pull away from the respirator if a protective hood is installed over the second skin, and wherein the brow support and temple supports form a top portion of a flange that encircles the concave interior to form an opening thereto, the flange forming a base for a flexible gasket which is spaced from and concentric with an outside perimeter of said second-skin, said flexible gasket including spaced slots to accommodate fastening straps of the respirator so that when the fastening straps are tightened the flexible gasket seals against the respirator.

2. The second-skin of claim 1, wherein said flexible gasket is integral with the support structure.

3. The second-skin of claim 2, wherein said flexible gasket and support structure are formed of different materials.

4. The second-skin of claim 3, wherein the material of said flexible gasket is more flexible than the material forming said support structure.

5. The second-skin of claim 4, wherein said support structure is coated with the material that forms said flexible gasket.

6. The second-skin of claim 1, wherein said support structure further includes spaced cheek supports below and integral with said temple supports, said temple supports and spaced cheek supports having a flattened exterior surface to provide a contact area between said exterior surface and the protective hood.

7. The second-skin of claim 6, wherein the cut-outs to accommodate said one or more respirator filters are present in said cheek supports.

8. The second-skin of claim 7, wherein said cheek supports include a recessed portion along each cut-out to aid in aligning the one or more respirator filters through the cut-outs.

9. The second-skin of claim 6, wherein said support structure further includes a bridge of the nose support integral with and extending between said cheek supports.

10. The second-skin of claim 9, wherein said exhalation valve cut-out is located below said bridge of the nose support and between said cheek supports.

11. The second-skin of claim 6, wherein said support structure further includes a chin support spaced below and integral with said cheek supports.

12. The second-skin of claim 11, wherein said chin support further includes a cut-out therein to accommodate a drink tube.

13. The second-skin of claim 1, wherein said flexible gasket forms a continuous perimeter spaced from and concentric with the outside perimeter of said second-skin.

14. The second-skin of claim 1, wherein said retention tab is present at a center of the rigid brow outsert between said temple supports.

* * * * *